US011647801B2

(12) United States Patent
Dee et al.

(10) Patent No.: US 11,647,801 B2
(45) Date of Patent: May 16, 2023

(54) METHODS FOR STABILIZING AND GARMENTS INCLUDING STABILIZED QUILTED INSULATION

(71) Applicant: Patagonia, Inc., Ventura, CA (US)

(72) Inventors: Kevin Dee, Bozeman, MT (US); Tetsuya O'Hara, Ojai, CA (US); Randall Harward, Ojai, CA (US)

(73) Assignee: Patagonia, Inc., Ventura, CA (US)

( * ) Notice: Subject to any disclaimer, the term of this patent is extended or adjusted under 35 U.S.C. 154(b) by 22 days.

(21) Appl. No.: 14/446,116

(22) Filed: Jul. 29, 2014

(65) Prior Publication Data

US 2016/0029725 A1 Feb. 4, 2016

(51) Int. Cl.

| | |
|---|---|
| ***A41D 31/06*** | (2019.01) |
| ***A47G 9/08*** | (2006.01) |
| ***A41D 3/00*** | (2006.01) |

(52) U.S. Cl.

CPC ..... *A41D 31/065* (2019.02); *A41D 3/00* (2013.01); *A47G 9/086* (2013.01)

(58) Field of Classification Search

CPC ..... A41D 31/02; A41D 31/0038; A41D 3/00; A41D 3/02; A41D 1/08; A41D 31/065;

(Continued)

(56) References Cited

U.S. PATENT DOCUMENTS 725,821 A * 4/1903 Berr ..... A47G 9/0207 5/502

3,801,420 A 4/1974 Anderson (Continued)

FOREIGN PATENT DOCUMENTS

CN 2307499 Y 2/1999
CN 201167724 Y 12/2008

(Continued)

OTHER PUBLICATIONS

International Preliminary Report on Patentability of PCT/US 15/42383 dated Jul. 14, 2016, 13 Pages.

(Continued)

*Primary Examiner* — Nathan E Durham

*Assistant Examiner* — Abby M Spatz

(74) *Attorney, Agent, or Firm* — Lowe Graham Jones PLLC

(57) ABSTRACT

Methods for stabilizing insulation and constructing garments from the insulation are disclosed. Methods include arranging the fibers into a plurality of bundle structures. The fibers may be synthetic fibers. The method may include receiving the bundle structures into bundle channels. The bundle channels are formed by tacks. The bundle channels enable the uniform distribution of the bundle structures prior to stitching quilting stitch lines. Multiple quilting stitch lines are stitched after the bundle structures are uniformly distributed. The quilting stitch lines are orthogonal to the longitudinal axis of the bundle structures. The quilting stitch lines provide lateral as well as longitudinal stabilization of the uniform density of the bundle structures. The distance between the quilting stitch lines may be based on the loft of the fibers and/or a required durability of the garment. The quilting stitch lines are generally horizontal, while the longitudinal axis of the bundle structures are vertical.

19 Claims, 12 Drawing Sheets

(58) Field of Classification Search
CPC ..... A47G 9/0207; A47G 9/086; D05B 11/00; D06M 17/00; D02G 3/40
USPC ..... 5/502; 428/102; 112/420
See application file for complete search history.

(56) References Cited

U.S. PATENT DOCUMENTS

| | | | | |
|---|---|---|---|---|
| 4,060,970 | A | 12/1977 | Talbot | |
| 4,079,568 | A | 3/1978 | Wortman | |
| 4,766,627 | A | 8/1988 | Landry | |
| 4,858,547 | A * | 8/1989 | Sternlieb | A47H 23/10 112/420 |
| 4,863,776 | A * | 9/1989 | Sternlieb | B32B 5/06 112/420 |
| 4,962,554 | A | 10/1990 | Tesch | |
| 5,299,333 | A * | 4/1994 | Pedersen | A47G 9/10 5/486 |
| 5,408,700 | A * | 4/1995 | Reuben | A41D 27/02 112/402 |
| 5,799,600 | A * | 9/1998 | Reuben | A47G 9/0207 112/420 |
| 6,115,859 | A | 9/2000 | Ozawa | |
| 2007/0197988 | A1 | 8/2007 | Bieling | |
| 2008/0271252 | A1 | 11/2008 | Abrigo | |
| 2013/0136892 | A1 * | 5/2013 | Ozawa | A47C 27/12 428/114 |

FOREIGN PATENT DOCUMENTS

| | | | |
|---|---|---|---|
| CN | 103097280 | A | 5/2013 |
| EP | 2692266 | | 2/2014 |
| EP | 2700742 | | 2/2014 |
| GB | 2159049 | A | 11/1985 |
| GB | 2453579 | A | 4/2009 |
| JP | 2001231663 | A | 8/2001 |
| JP | 2003010032 | A | 1/2003 |
| JP | 2012067429 | A | 4/2012 |

OTHER PUBLICATIONS

International Search Report of PCT/US2015/042383 dated Sep. 21, 2015, 53 Pages.
Second Office Action; dated Oct. 15, 2018; 40 pages.
Office Action dated Apr. 26, 2019 for co-pending Chinese Patent Application No. 201580043802.3, pp. 28.
Examination Report dated Jul. 9, 2019 for co-pending European Patent Application No. 15753526.1, pp. 4.
Examination Report dated Dec. 17, 2018 for co-pending European Patent Application No. 15753526.1, pp. 4.
First Office Action dated Sep. 17, 2019 for co-pending Japanese Patent Application No. 2017-505237, 41 pages.
Office Action dated Aug. 24, 2020 for co-pending Canadian Patent Application No. 2,956,597, 4 pages.

* cited by examiner

METHODS FOR STABILIZING AND GARMENTS INCLUDING STABILIZED QUILTED INSULATION

TECHNICAL FIELD OF THE INVENTION

The invention relates generally to a stabilizing insulation and more specifically to stabilizing insulating spun yarn for application in cold weather garments.

BACKGROUND OF THE INVENTION

Natural fibers, such as goose down are often employed to form insulating layers in jackets, parkas, pants, sleeping bags, mittens, and other garments used for cold weather activities, including but not limited to mountaineering, skiing, snowboarding, snowmobiling, and winter camping. Down provides good insulation per unit mass, retains shape and loft well, and is highly compressible, comfortable, and lightweight.

However once wet, the ability of down garments to insulate is greatly reduced. Furthermore, moisture can become trapped within the down fibers. Thus, once wet, down garments take a significant amount of time to dry out and regain their insulating abilities. Additionally, down garments should not be cleaned with typical cleaning agents, such as soaps or detergents. Typical cleaning agents are generally too harsh for the delicate down fibers. Down is also a relatively costly insulating material.

To address these deficiencies, many varieties of cold weather garments employ synthetic fibers to provide insulating layers. Synthetic fibers tend to be less expensive, retain a greater portion of their insulating properties when exposed to moderate levels of moisture, and dry quicker than down. However, synthetic fibers include their own set of tradeoffs.

For instance, for a similar amount of insulating ability, synthetic fibers tend to be heavier than down. Also, synthetic fibers tend to break down more quickly than down from repeated cycles of compression. Because cold weather garments are often compressed and packed in stuff sacks or backpacks, synthetic garments tend to have shorter lifespans than down garments. Furthermore, synthetic insulation is typically constructed from synthetic batting materials. These synthetic batting materials may not provide as much comfort to a wearer as down filled garments. Furthermore, down insulating layers that are not adequately stabilized may be prone to shifting. Such shifting may result in "cold" spots in the garment, as well as overly "puffy" spots. It is for these and other concerns that the following disclosure is offered.

SUMMARY OF THE INVENTION

Various methods of the present disclosure are directed towards methods for stabilizing insulation that includes a plurality of fibers, wherein each of the plurality of fibers includes a longitudinal axis. In some of the embodiments, the method includes arranging at least a portion of the plurality of fibers into a bundle structure. The fibers may be synthetic fibers. The bundle structure includes the portion of the plurality of fibers and a longitudinal axis substantially parallel with the longitudinal axis of each of the included fibers.

The method may include forming at least one bundle channel defined by a portion of a first fabric layer and a portion of a second fabric layer. The bundle channel includes a bundle channel longitudinal axis. The method may also include receiving the bundle structure. In some embodiments, the bundle structure may be received within the at least one bundle channel. The bundle structure is disposed intermediate the first fabric layer and the second fabric layer. The longitudinal axis of the bundle structure is substantially parallel with the bundle channel longitudinal axis. The method may additionally include forming a first quilting stitch line that is substantially transverse to the longitudinal axis of the bundle structure. The first quilting stitch line couples the bundle structure to at least one of the first fabric layer and the second fabric layer. The bundle structure is longitudinally and laterally stabilized by at least the first quilting stitch line.

In various embodiments, the at least one bundle channel is formed by a plurality of bundle channel stitch lines that are substantially parallel to the bundle channel longitudinal axis and the plurality of bundle stitch lines couples the first fabric layer and the second fabric layer. The method may also include forming a second quilting stitch line. The second quilting stitch line is displaced from the first quilting stitch line by a predetermined distance based on at least one of a loft of the plurality of fibers or a durability of a garment constructed from the first and second fabric layers. In at least one embodiment, the predetermined distance is between 2 and 4 inches. In some embodiments, the first quilting stitch line is substantially orthogonal to the longitudinal axis of the bundle structure.

The method may further include forming a plurality of bundle channels by a first plurality of tacks. The first plurality of tacks is disposed adjacent to a first edge of the first fabric layer. A corresponding second plurality of tacks may be formed and disposed adjacent to a second edge of the first fabric layer. Consecutive tacks in the first plurality of tacks are separated by a predetermined distance. Each of the second plurality of tacks is aligned with a corresponding tack in the first plurality of tacks.

In some embodiments, at least one bundle channel is configured and arranged to at least partially stabilize a distribution of a plurality of bundle structures received by the at least one bundle channel prior to forming the first quilting stitch line. At least 20 bundle structures are received in the bundle channel. In a preferred embodiment, the bundle channel receives at least 30 bundle structures.

In at least one embodiment, the method further includes bunching the bundle structure to increase a volume of dead air intermediate the first fabric layer and the second fabric layer. The method may include receiving the bundle structure within at least one bundle channel. The received bundle structure is positioned between the first fabric layer and the second fabric layer. The bundle structure may be bunched within the at least one bundle channel. At least a portion of the longitudinal axis of the bundle structure is substantially serpentine within the at least one bundle channel. In at least one embodiment, the bundle structure is substantially flat within the bundle channel.

The garment is, in at least one preferred embodiment, a parka. In other embodiments, the garment may be trousers or a sleeping bag. When the garment is worn, the first quilting stitch line may be substantially horizontal and the longitudinal axis of the bundle structure is substantially vertical.

Some embodiments of the present disclosure are directed towards an insulating garment that includes an inner layer, an outer layer, a first quilting stitch line, a second quilting stitch line and an insulating layer disposed intermediate the inner layer and the outer layer. For instance, the inner layer may be a first layer and the outer layer may be a second layer. The inner layer may be a lining material. In some embodiments, the outer layer is a shell material. The insulating layer may include a bundle structure. The bundle structure includes, in at least one embodiment, a plurality of yarn strands. Each yarn strand includes a longitudinal axis. The bundle structure is received such that the bundle structure is disposed intermediate the inner layer and the outer layer. In some embodiments, the bundle structure may be received by a bundle channel. The longitudinal axis of the yarn strands is substantially parallel with a bundle channel longitudinal axis. The first and the second quilting stitch lines are separated by a predetermined distance based on at least a loft of the plurality of yarn strands. The inner layer may be coupled to the outer layer by tacks and/or stitches.

Still other embodiments may be directed at an insulated garment that includes a plurality of yarn strands. Each of the plurality of yarn strands includes a longitudinal axis. The garment may be manufactured by a process including bundling at least a portion of the plurality of yarn strands into a bundle structure. The bundle structure includes the portion of the plurality of fibers and a longitudinal axis substantially parallel with the longitudinal axis of each of the included fibers.

The method may further include forming at least one bundle channel. The at least one bundle channel is defined by a portion of an inner layer of the garment and a portion of an outer layer of the garment. The bundle channel includes a bundle channel longitudinal axis. The method includes receiving the bundle structure within the at least one bundle channel. The bundle structure is disposed intermediate the inner layer and the outer layer of the garment. The longitudinal axis of the bundle structure is substantially parallel with the bundle channel longitudinal axis. The method further includes forming a first quilting stitch line. The first stitch line is substantially transverse to the bundle channel longitudinal axis. The first quilting stitch line couples the inner layer to the outer layer of the garment. The bundle structure is longitudinally and laterally stabilized by at least the first quilting stitch line.

The insulating layer disposed intermediate the inner layer and the outer layer may have a first bundle structure and a second bundle structure. Each of the first and the second bundle structures may include a plurality of yarn strands. Each yarn strand may include a core yarn having a longitudinal axis and a plurality of at least one of tendrils and spirals around the core yarn, with each of the first and second bundle structures having a longitudinal axis. The first bundle structure may be disposed laterally adjacent the second bundle structure. The first and second bundle structures may not be completely isolated one from the other such that the at least one of the tendrils and the spirals of both of the first and second yarn strands at least partially fill the space between the core yarns of the first and second bundle structures and provide loft and insulation. The first and second bundle structures may be disposed intermediate the inner layer and the outer layer. First and the second coupling lines may be each transverse to each of the first and the second bundle structures' longitudinal axis, with each of the first and second coupling lines securing at least one of the first and second bundle structures. The insulating layer may consist of the first and second bundle structures and a plurality of other bundle structures, with each of the plurality of other bundle structures having a plurality of yarn strands, and each of the yarn strands may include a core yarn having a longitudinal axis and a plurality of at least one of tendrils and spirals around the core yarn of each of the plurality of other bundle structures. The respective longitudinal axis of each of the first bundle structure, the second bundle structure, and the plurality of other bundle structures may be spatially discontiguous in at least two dimensions relative to each respective longitudinal axis of each other one of the first bundle structure, the second bundle structure, and the plurality of other bundle structures disposed between the inner layer and the outer layer, with each of the first bundle structure, the second bundle structure, and the plurality of other bundle structures held side by side by the coupling lines.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

To facilitate the understanding of this invention, a number of terms are defined below. Terms defined herein have meanings as commonly understood by a person of ordinary skill in the areas relevant to the present invention. Terms such as "a," "an," and "the" are not intended to refer to only a singular entity, but include the general class of which a specific example may be used for illustration. The terminology herein is used to describe specific embodiments of the invention, but their usage does not delimit the invention, except as outlined in the claims.

Figure 1A:
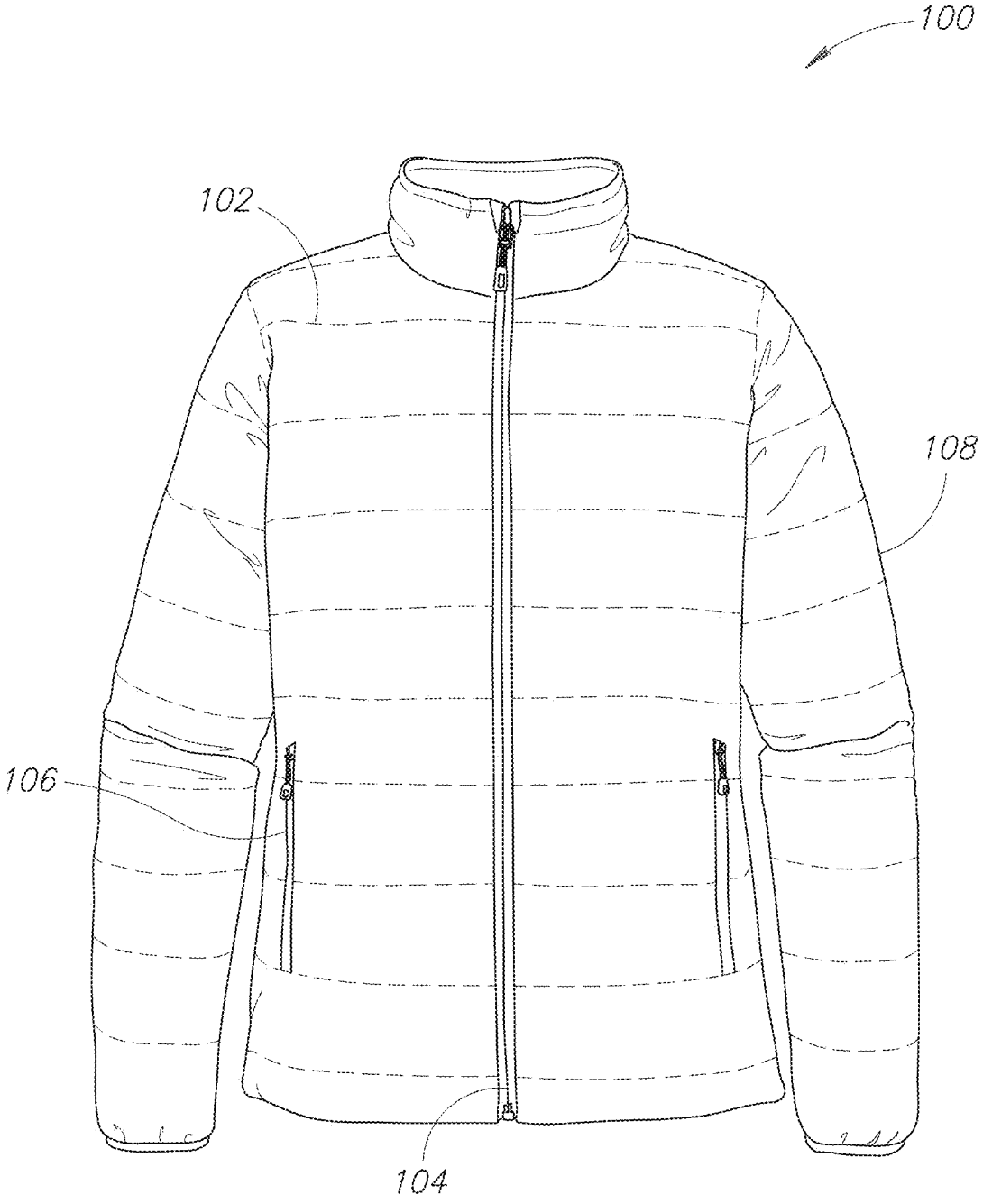
FIG. 1A illustrates an insulating parka that includes insulation stabilized with methods consistent with the various embodiments disclosed herein.

FIG. 1A illustrates an insulating parka 100, or jacket, that includes insulation stabilized with methods consistent with the various embodiments disclosed herein. Various embodiments of insulating garments, such as insulating parka 100, include at least an inner fabric layer and an outer fabric layer. Insulating material, such as yarn, is disposed between the inner fabric layer and the outer fabric layer. More specifically, the insulating material may form an insulating layer of insulating parka 100. The insulating layer may be disposed adjacent to a first surface of the inner fabric layer and adjacent to a first surface of the outer fabric layer, as well as intermediate the first surfaces of the inner and outer layer.

Although the terms inner fabric layer and outer fabric layer (or inner layer and outer layer) are used throughout the present disclosure, the inner layer may not be the innermost layer of the garment. Likewise, the outer layer may not be the outermost layer of the garment. Rather, the terms are applied in a relative sense. The inner layer is more adjacent to the wearer than the outer layer.

Insulating parka 100 includes stitch lines 102 that form a quilting pattern. In various embodiments, the quilting stitch lines 102 couple or otherwise affix the inner fabric layer and the outer fabric layer along quilting stitch lines 102. Coupling the inner and outer fabric layers in such a fashion creates baffles or channels between the two fabric layers. As illustrated in FIG. 1A, insulating parka 100 includes multiple quilting stitch lines 102, which creates multiple channels.

Quilting stitch lines 102 are generally parallel with one another (when the fabric layers are generally arranged flat in a planar fashion) and preferably uniformly spaced, forming uniform channels. As will become clear in the discussion regarding FIGS. 3B-7, quilting stitch lines 102 are preferably oriented substantially transverse to a longitudinal axis of the insulating material. The transverse orientation of quilting stitch lines 102 stabilizes, secures, and otherwise anchors the insulating material. In addition, quilting stitch lines 102 are generally horizontal, such that when insulating parka 100 is worn, quilting stitch lines 102 are transverse to the gravitational force vector. Orienting quilting stitch lines 102 transverse to gravity enhances the stabilization of the insulating material.

In some embodiments, insulating parka 100 includes a zipper 104, or another fastener such as buttons, snaps, hook and loop material, and the like to fasten the opening in the center front of parka 100. Other embodiments may be a "pull-over" style parka that do not include a fastener, but rather are put on and taken off by pulling over the wearer's head and shoulders. Still other embodiments may be a "hoodie" style parka. Hoodie style parkas may provide enhanced insulation for the wearer's head. In various embodiments, insulating parka 100 is a "puffy" style jacket or parka.

Insulating parka 100 includes pockets 106. Some embodiments may include zippers or other fasteners to securely close pockets 106. Insulating parka 100 additionally includes articulated arms 108 to provide enhanced comfort during activities such as mountaineering, climbing, or controlling vehicles with a handlebar style steering assembly. Participants in these sorts of activities often employ insulating garments, such as insulating parka 100, to provide a controlled climate for their torso region. Although not shown, some embodiments may include vents to provide ventilation during vigorous activity. Vents may be opened and closed with any suitable fastener.

Figure 1B:
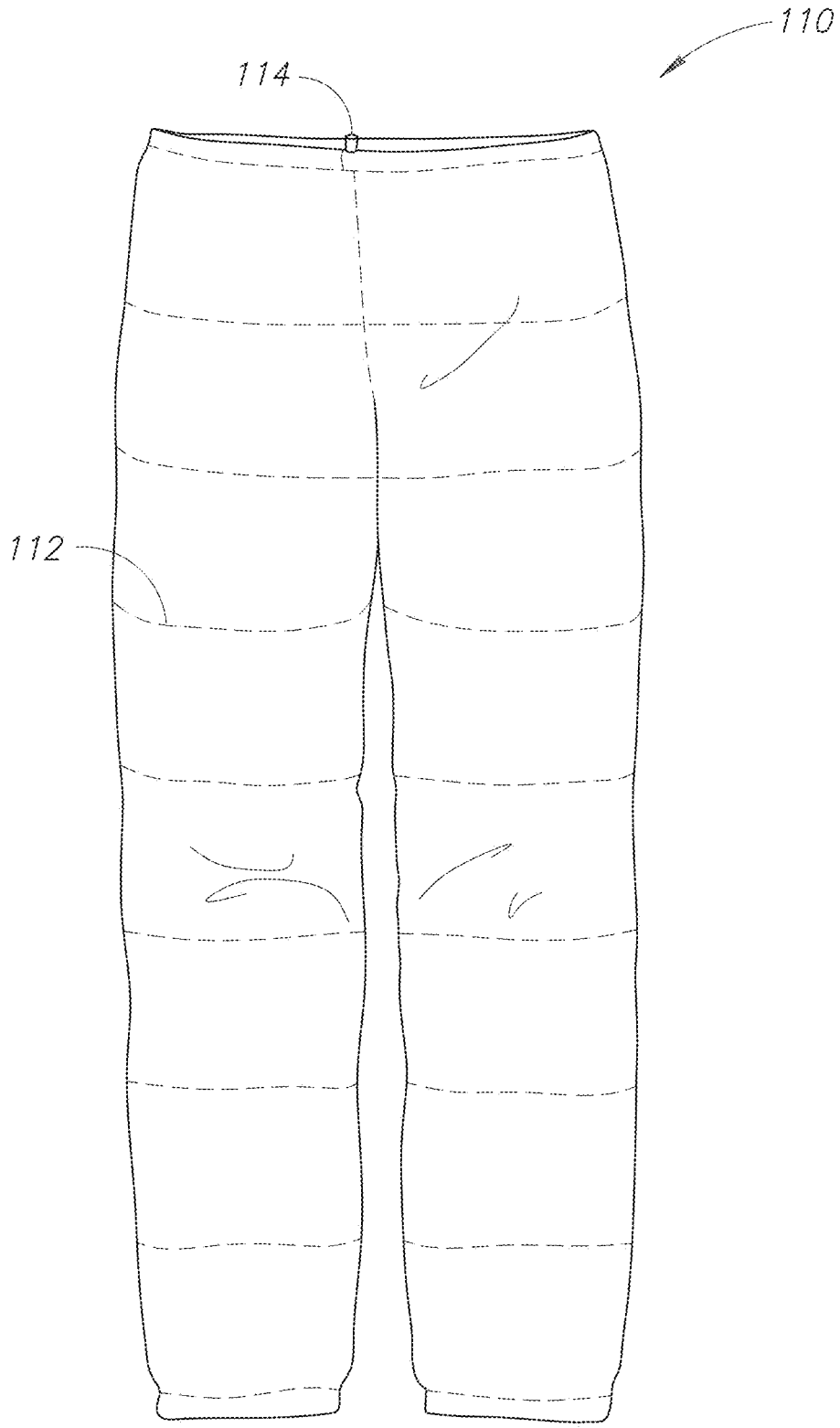
FIG. 1B illustrates insulating trousers that include insulation stabilized with methods consistent with the various embodiments disclosed herein.

FIG. 1B illustrates insulating trousers 110 that include insulation stabilized with methods consistent with the various embodiments disclosed herein. Insulating trousers 110 include multiple quilting stitch lines 112. As with insulating parka 100 of FIG. 1A, quilting stitch lines 112 are employed to stabilize insulating material included in insulating trousers 110. Waist cinching means 114 may be included in insulating trousers 110 to help secure insulating trousers 110 about a wearer's waist.

Figure 1C:
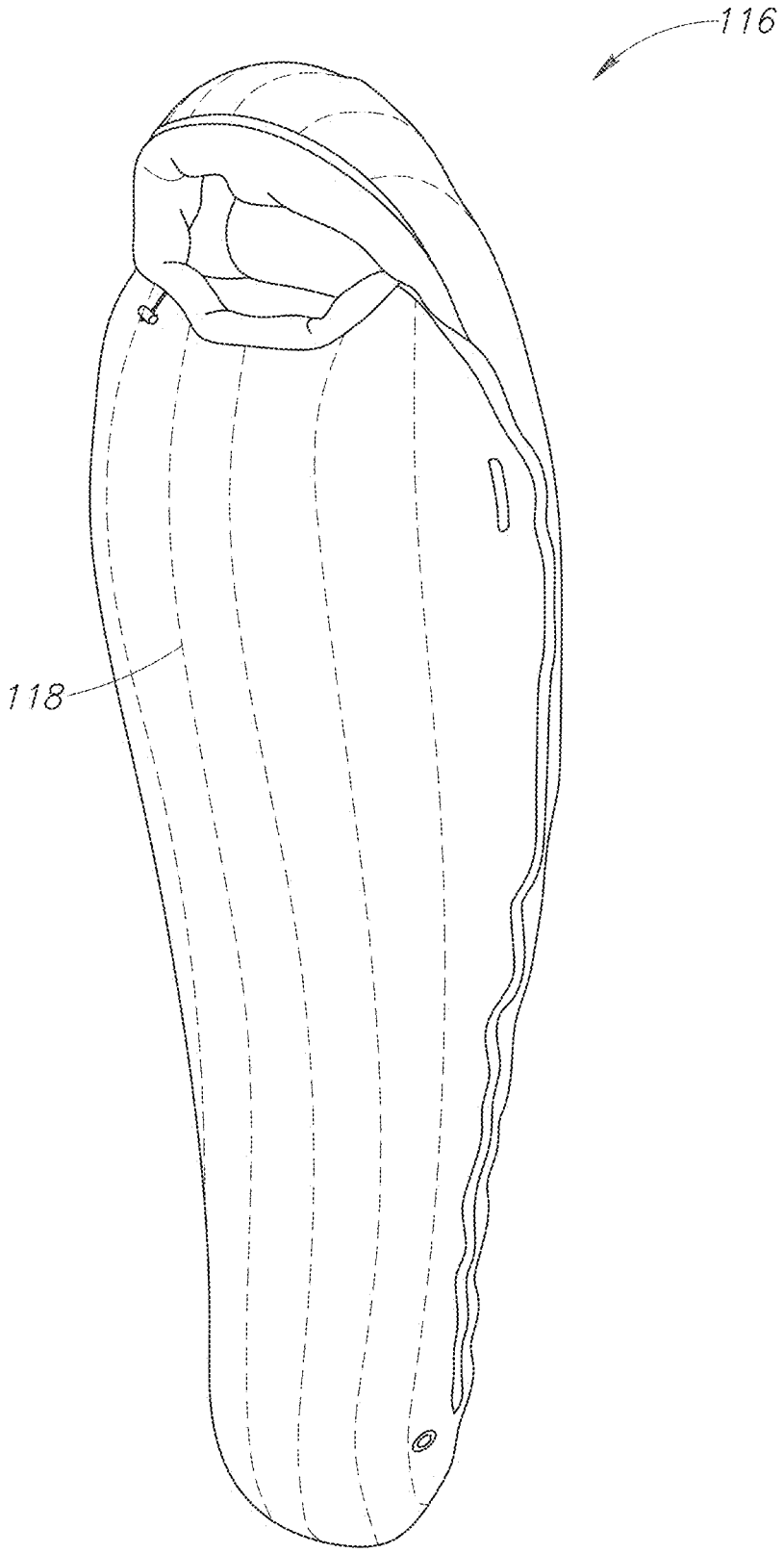
FIG. 1C illustrates an insulating "mummy" style sleeping bag that includes insulation stabilized with methods consistent with the various embodiments disclosed herein.

FIG. 1C illustrates an insulating "mummy" style sleeping bag 116 that includes insulation stabilized with methods consistent with the various embodiments disclosed herein. As with insulating parka 100 of FIG. 1A and insulating trousers 110 of FIG. 1B, quilting stitch lines 118 are employed to stabilize insulating material included in sleeping bag 116.

Figure 2B:
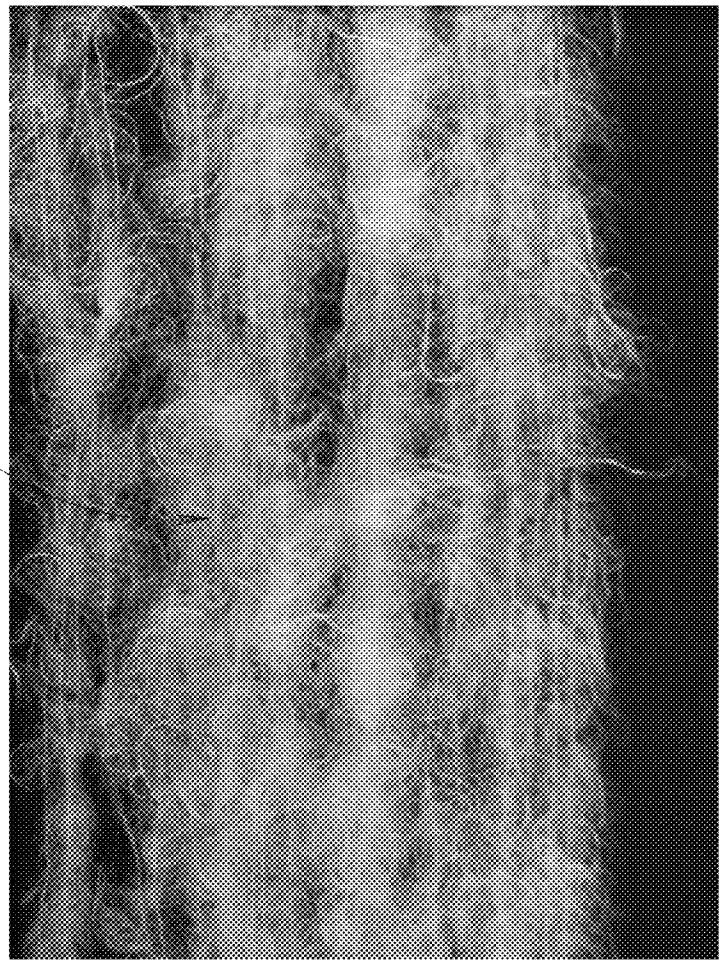
FIG. 2B illustrates an insulating bundle that includes multiple strands of yarn, such as the strand of yarn illustrated in FIG. 2A. The bundle is employed as insulation within a garment, such as those garments illustrated in FIG. 1A, 1B, or 1C, and stabilized with methods consistent with the various embodiments disclosed herein.
Figure 2A:
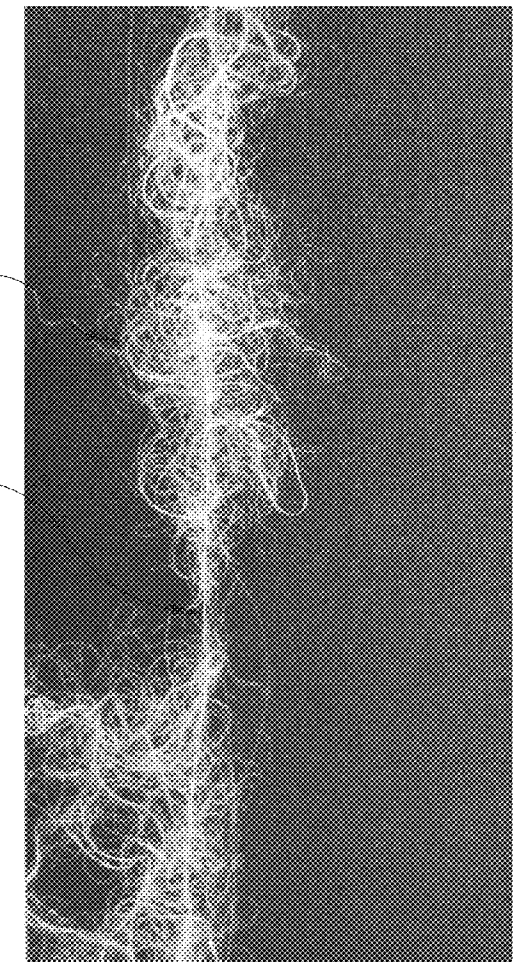
FIG. 2A illustrates a strand of yarn that is employed as an insulating material within a garment, such as those garments illustrated in FIGS. 1A, 1B, and 1C. The strand of yarn may be stabilized with methods consistent with the various embodiments disclosed herein.

FIG. 2A illustrates a strand of yarn 220 that is employed as an insulating material within a garment, such as those garments illustrated in FIGS. 1A, 1B, and 1C. Strand of yarn 220 may be stabilized with methods consistent with the various embodiments disclosed herein.

In some embodiments, strand of yarn 220 is a spun strand of yarn. Strand of yarn 220 may be produced from various types of natural or synthetic fibers, including but not limited to wool, polyester, nylon, or rayon. In various embodiments, the fibers are treated to add functionality, such as antibacterial, hydrophobic, or flame proofing properties. Although the present disclosure is not so constrained, strand of yarn 220 is preferably a synthetic spun strand of yarn. Strand of yarn 220 includes yarn core 222 and numerous tendrils and/or spirals 224.

FIG. 2B illustrates an insulating bundle of yarn 230 that includes multiple strands of yarn, such as the strand of yarn 220 illustrated in FIG. 2A. Bundle 230 is employed as insulation within a garment, such as those garments illustrated in FIG. 1A, 1B, or 1C, and is stabilized with methods consistent with the various embodiments disclosed herein. In a preferred embodiment, the strands of yarn that are included in bundle 230 have a looseness that give bundle 230 body.

FIG. 2B illustrates bundling of the multiple strands of yarn 236 into spun yarn bundle 230. In some embodiments, this bundling forms a fluffy textile with body and enhanced insulating capabilities. The resulting insulation has a soft, compressible, quality feel like that of down insulation. Additionally, if compressed, such as when a garment employing the textile is compressed in a stuff-sack, this fluffy textile generally returns to its original size and density after the compression force is released.

As shown in bundle 230, the tendrils and/or spirals, such as tendrils and/or spirals 224 of FIG. 2A, may extend and at least partially fill interstices between the cores of each of the yarns included in bundle 230. By at least partially filling these interstices, the tendrils and/or spirals may provide garments constructed from such a bundle with increased body and/or loft, as well as an increased ability to insulate a wearer of such a garment.

As will be discussed in detail in the context of FIG. 8, the density of a bundle may be varied to obtain desired levels of insulation, compressibility, longevity, and "fluffiness." These various properties may be tailored to the anticipated use of the garment to be constructed. Bundle 230 is a relatively low-density bundle of yarn. Bundle density may be increased or decreased from that of bundle 230, depending upon the required levels of insulation, compressibility, longevity, and "fluffiness," for the garment.

Figure 3A:
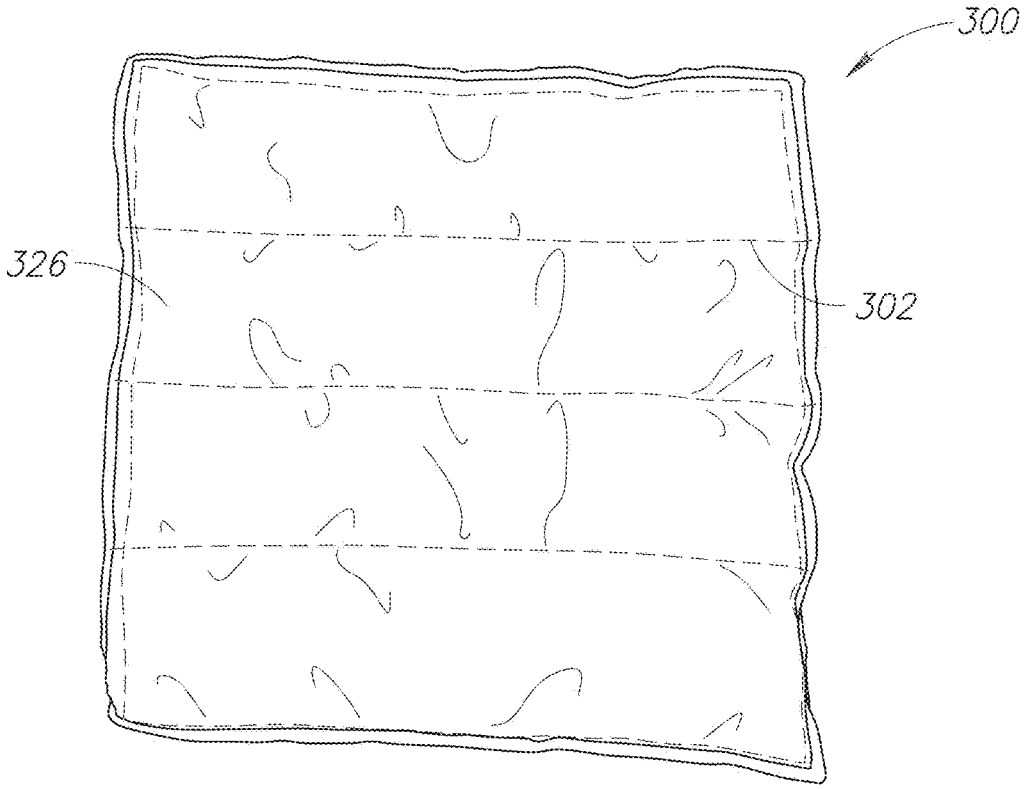
FIG. 3A illustrates a portion of an insulating garment, such as those garments illustrated in FIG. 1A, 1B, or 1C, where the insulation is stabilized with methods consistent with the various embodiments disclosed herein.

FIG. 3A illustrates a portion of an insulating garment 300, such as those garments illustrated in FIG. 1A, 1B, or 1C, where the insulation is stabilized with methods consistent with the various embodiments disclosed herein. Garment portion 300 includes multiple quilting stitch lines 302, which form baffles creating channels 326. The outer fabric layer of the garment is shown.

Figure 3B:
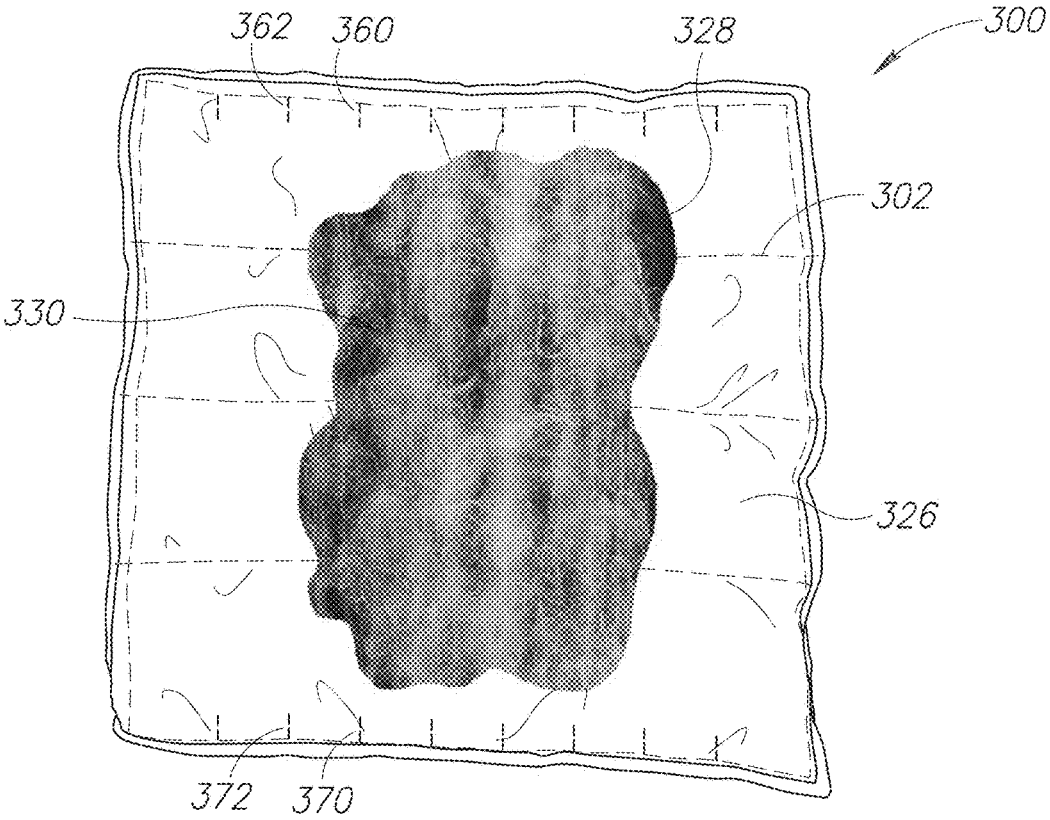
FIG. 3B illustrates a portion of an insulating garment, such as those garments illustrated in FIG. 1A, 1B, or 1C that includes a transparent cutaway window to view an insulating bundle, such as the bundle shown in FIG. 2B, that was stabilized with methods consistent with the various embodiments disclosed herein.

FIG. 3B illustrates a portion of an insulating garment 300, such as those garments illustrated in FIG. 1A, 1B, or 1C. Insulating garment portion 300 is illustrated with a transparent cutaway window 328 to view a close up of multiple insulating bundles, including bundle 330 that is disposed intermediate the inner and outer fabric layers of garment portion 300. Bundle 330 may have two or more strands and preferably at least twenty strands of yarn. More or less strands may be employed in each bundle depending on the insulating properties desired for the particular garment. Insulating bundle 330 is stabilized with methods consistent with the various embodiments disclosed herein. One embodiment of stabilizing the bundles is illustrated somewhat schematically in FIG. 3C. Alternative methods that are consistent with the embodiments disclosed herein are somewhat schematically illustrated in FIGS. 9A and 9B.

Garment portion 300 includes multiple quilting stitch lines 302, which form channels 326 between the stitch line baffles. The outer fabric layer of the garment is shown. Various embodiments of garments, such as those shown in FIGS. 4-7, include multiple bundles to form an insulating layer intermediate the inner and outer garment layers.

The longitudinal axis of bundle 330 (which is also the longitudinal axis of the strands of yarn that are included in bundle 330) is generally transverse to quilting stitch lines 302. As shown in FIG. 3B, in some embodiments, the relative transverse orientation of bundle 330 and quilting stitch lines 302 is an orthogonal or perpendicular orientation that forms an approximately 90° angle between the longitudinal axis of the strands of yarn in bundle 330 and quilting stitch lines 302. Other embodiments are not so constrained and the relative orientation may form an acute angle, such as 80°, 60°, 45°, 30°, or any other such angle between the longitudinal axis of the strands of yarn and quilting stitch line 302.

This transverse orientation stabilizes bundle 330, as well as each of the strands of yarn that are included in bundle 330, in both the longitudinal and transverse direction (as defined by the strands of yarn). Because (1) the insulating material is disposed intermediate the inner and outer surfaces of garment portion 300, (2) quilting stitch lines 302 couple the inner and outer layers of garment portion 300, and (3) the longitudinal axis of the insulating material is transverse to quilting stitch lines 302, the positioning of the insulating material is stabilized.

In a preferred embodiment, when the garment is worn, quilting stitch lines 302 are oriented horizontally and bundle 330 is oriented vertically, although embodiments need not to be so constrained. Horizontal stitch lines 302 are preferably uniformly vertically spaced. The embodiments are not constrained to any specific separation distance between consecutive quilting stitch lines 302. However, in preferred embodiments, the spacing between consecutive quilting stitch lines is generally between two and four inches.

Figure 8:
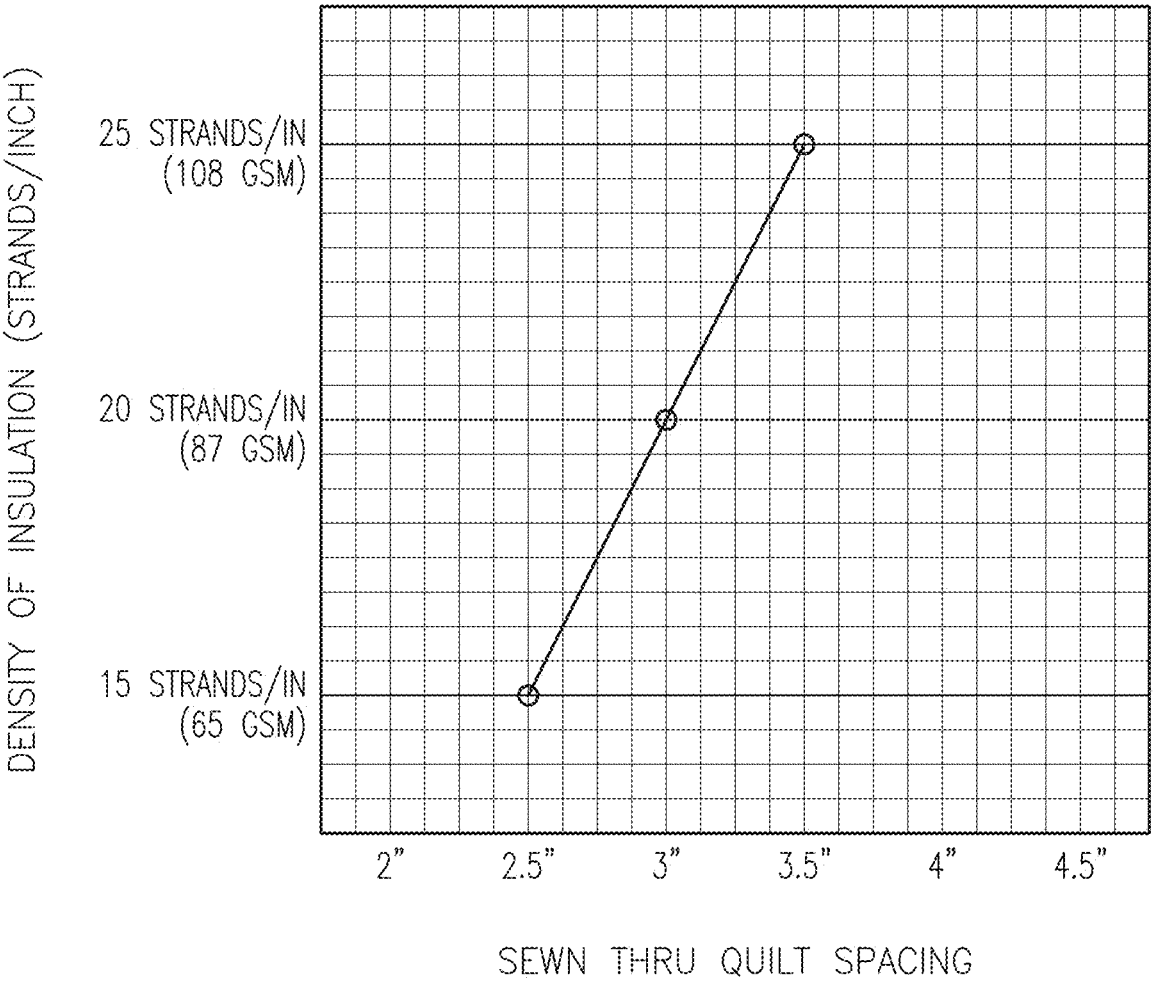
FIG. 8 is a graph that illustrates preferred insulation densities as a function of quilting stitch line spacing.

As is discussed in the context of FIG. 8, the spacing between quilting stitch lines 302 varies as a function of the density of strands of yarn included in the side-by-side bundles 330. The density of strands of yarn included in bundles 330 may be varied based on the desired properties of the garment to be constructed. In some embodiments, bundle density may be varied by varying the number of yarn strands that are included in a single bundle or by varying how closely the individual strands of yarn are packed together and how closely the bundles are packed together. Individual strands of yarn may be braided or cabled with other strands of yarn to form a dense bundle. As in discussed in detail in regards to FIG. 3C, the garment layers may include tacks or stitches, such as tacks 360, 362, 370, and 372.

Figure 3C:
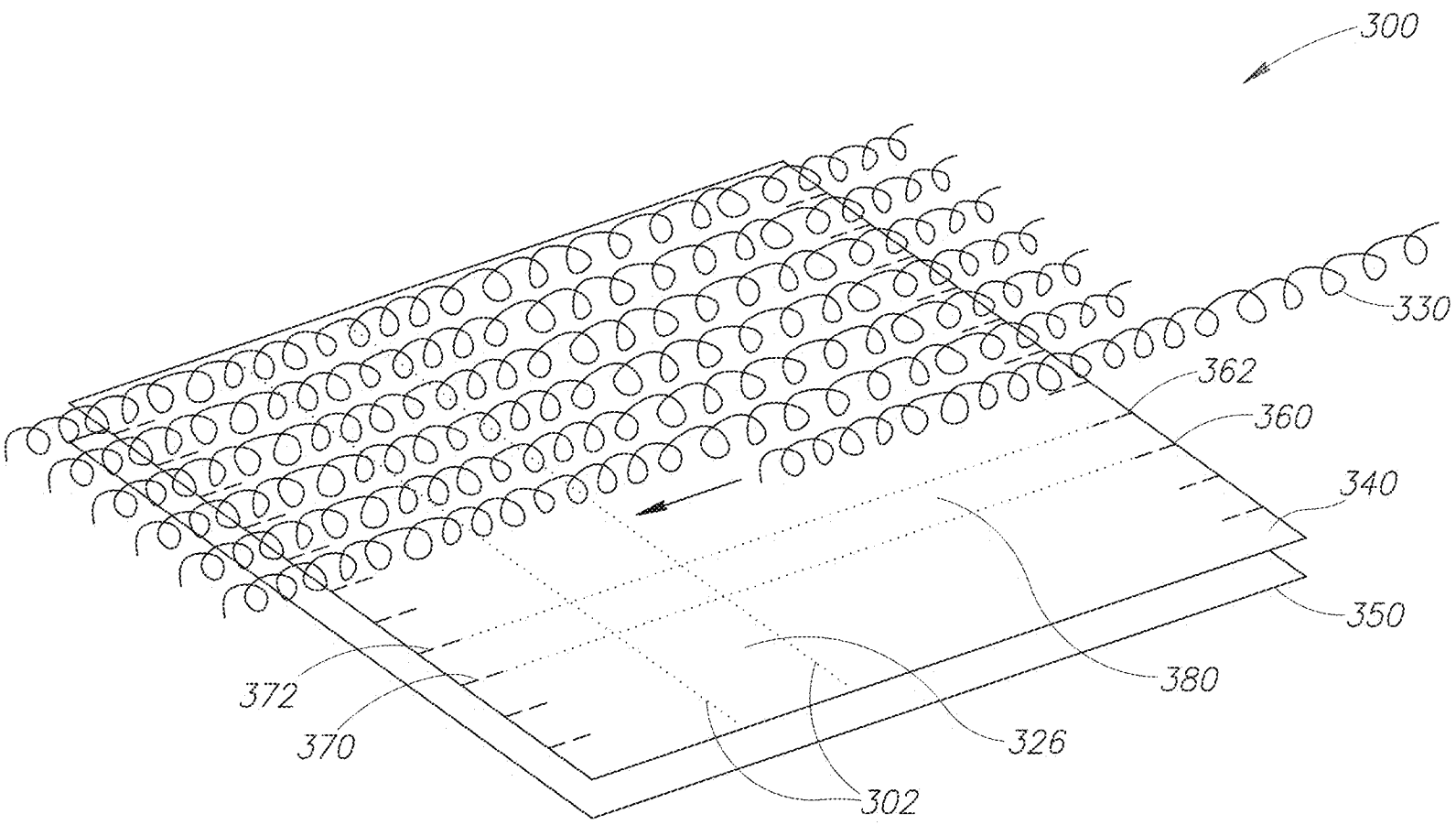
FIG. 3C illustrates a method of stabilizing a plurality of insulating fibers. The method being consistent with the various embodiments disclosed herein.

FIG. 3C illustrates a method of stabilizing a plurality of insulating fibers. The method being consistent with the various embodiments disclosed herein. These and other methods may be employed in the construction of an insulating garment, including the portion of insulating garment 300. The method being consistent with the various embodiments disclosed herein.

The method illustrated in FIG. 3C allows for the even distribution of insulating bundles, such as insulating bundle 330 (shown schematically as a rough spiral). Although shown as a rough spiral, at least some of the yarns that are included in each of the bundles, such as bundle 330 include fibrous tendrils such as tendril 224 of FIG. 2A. Furthermore, the method allows for the temporary stabilization of the distribution of the bundles prior to the stitching of quilting stitch lines. Note that dotted outlines 302 for two parallel quilting stitch lines are shown in FIG. 3C. The view illustrated in FIG. 3C is prior to stitching of quilting stitch lines. The dotted lines 302 are shown for reference only and indicate where stabilizing quilting stitch lines may be stitched after the bundles have been laid out and evenly distributed.

The portion of insulating garment 300 includes inner fabric layer 340 and outer fabric layer 350. In a preferred embodiment, the portion of insulating garment 300 includes a plurality of tacks. Tacks may include stitching. For instance, tacks such as tacks 360 and 362 may be placed at approximately regular intervals along a first edge of at least one of the inner fabric layer 340 and the outer fabric layer 350. Additionally, tacks, such as tacks 370 and 372 may be placed at approximately the same regular intervals along a second edge that is substantially parallel with the first edge of at least one of the inner fabric layer 340 and the outer layer 350. The tacks along the first and second edges are substantially aligned such that an axis between a first tack along the first edge and a corresponding second tack along the second edge (for instance tack 360 and 370 respectively) is substantially parallel with another axis between a third tack along the first edge and a corresponding fourth tack along the second edge (for instance tac 362 and 372 respectively). Each of these axis are shown in dotted lines between the corresponding tacks 360/370 and 362/372. Note that these dotted lines are not stitch lines, but rather, as with the dotted lines 302, are drawn for illustrative purposes only.

In a preferred embodiment, each of the tacks includes stitches that couple inner fabric layer 340 and outer fabric layer 350. As illustrated in FIG. 3C, the stitch line included in each of the tacks may be substantially orthogonal to the first and second edges of the fabric layers. The tack stitch lines are substantially orthogonal to quilting stitch lines that may eventually be stitched. The locations of two such quilting stitch lines are illustrated as dotted lines 302 in FIG. 3C. The length of each tack stitch line may be between 0.5 mm and 20.0 mm depending on the requirements of garment portion 300. In one preferred embodiment, the length of the tack stitch line is approximately 5 mm. However, other embodiments are not so constrained, and any length of stitch lines may be employed for the tacks. In one preferred embodiment, the tacks provide a guide to align and uniformly distribute bundles, such as bundle 330.

The plurality of tacks form bundle channels that are open at each of the first and second edges of the fabric layers. For instance, tacks 360, 362, 370, and 372 form bundle channel 380. The approximate boundaries of bundle channel 380 are shown by the dotted line drawn between tacks 360 and 370 and the dotted line drawn between tacks 362 and 372. Because the tacks are placed at regular intervals and are aligned with the corresponding tacks of the other fabric edge, the bundle channels are of approximately equal width. Corresponding tacks couple inner fabric layer 340 and outer fabric layer 350 along the length of the stitch lines.

In some embodiments, consecutive bundle channels are not completely isolated from one another because the stitch lines, or tacks, do not run the length of the sides of the bundle channels. Rather as illustrated in FIG. 3C, the stitch lines of the tacks isolate consecutive bundle channels at only a portion of the length of the sides of the bundle channels. For instance, tacks 360, 362, 370, and 372 isolate bundle channel 380 from its consecutive bundle channels on either side for only the length of the tacks 360, 362, 370, and 372. Because the volumes or boundaries of consecutive bundle channels are not completely isolated from one another, bundle channels may be virtual bundle channels. The primary purpose of the tacks is to hold the bundles in place for quilting. The quilting provides the preferred long-term stabilization.

A plurality of bundles, such as bundle 330, may be received by each of these bundle channels, such as bundle channel 380. In some embodiments, bundle 330 is received into its corresponding bundle channel through the opening in one of ends of the bundle channel. To ensure even distribution of the bundles, an approximately equal number of bundles may be received by each of the bundle channels. In a preferred embodiment, a single bundle is received per bundle channel. The axis of each of the bundle channels is substantially parallel with the axis of each of the bundles. The axis of each of the bundle channels may be substantially orthogonal to the channel 326 that will be formed by quilting stitch lines 302.

The tacks and the bundle channels formed by the tacks allow for the even distribution of insulating bundles throughout the garment portion 300. In some embodiments, the distance between consecutive tacks along a fabric edge (and thus the width of each bundle channel) is between one and two inches. In at least one preferred embodiment, the width of each bundle channel is approximately 1.5 inches. However, other embodiments are not so constrained and the distance separating consecutive tacks may be varied as required by the garment. In a preferred embodiment, approximately 30 yarn strands form a bundle. Each bundle channel receives a bundle that includes 30 yarn strands. However, other embodiments are not so constrained and the density of yarns per bundle, as well as the density of bundles per bundle channel, may be varied as required by the garment.

For illustrative purposes, inner fabric layer 340 is transparent in FIG. 3C to show a single bundle being received by some of the bundle channels formed by the tacks. Bundle 330 is shown in mid-insertion into its corresponding bundle channel. The arrow shows the direction of insertion. In some embodiments, bundles are received intermediate the inner fabric layer 340 and the outer fabric layer 350 along the bundle channel opening along the first fabric edges. The bundle may slightly exit the bundle channel through the bundle channel opening along the second fabric edges. The exposed ends of the bundles may be trimmed even with the fabric before finishing the edges of the garment.

After each of the bundle channels, including bundle channel 380, have received the appropriate number of bundled yarn strands, the quilting stitch lines 302 may be stitched transverse to the bundle channels, forming channel 326. Because tacks or stitches at least partially retain the bundle channels from shifting and at least partially couple inner fabric layer 340 and outer fabric layer 350, the lateral distribution of the bundles is at least partially stabilized prior to and during the stitching of quilting stitch lines 302. This stabilization provided by the tacks and bundle channel allows for handling and/or transporting the garment material without significantly perturbing the uniform density of bundles prior to stitching the quilting stitch lines. In at least one embodiment, the tacks are temporary tacks. In such embodiments, the tacks may be removed after the bundles have been stabilized by the quilting stitch lines. For example, the tacked edges of a large sheet of the quilted layers may be trimmed off.

Stitch lines are only one example of a tacking mechanism. In alternative embodiments, other tacking mechanisms may be employed. For instance, a "sticky" or "tacky" substance, such as an adhesive epoxy or resin, may be applied to regions of at least one of the inner fabric layer 340 or outer fabric layer 350 to couple the corresponding portions of the inner fabric layer 340 and the outer fabric layer 350. Any mechanism that, at least temporarily, couples the inner and outer fabric layers, in a way that is similar to stitch lines, may be employed as tacks.

The density that the strands are configured into bundles is determined based on required properties of the garment to be constructed, such as desired levels of insulation, compressibility, durability, and "fluffiness." When the bundles are intermediate the inner fabric layer 340 and the outer fabric layer 350, a layer of insulating yarn rests against an inner surface of the inner fabric layer 340 and the outer fabric layer 350, wherein the density of the yarn layer is dependent upon the average spacing between adjacent strands of yarn and on the spacing between the yarn bundles.

After all the bundles have been received by the bundle channels, such that the bundles are evenly distributed, a first quilting stitch line is stitched that couples the inner layer and outer layer. In various embodiments, the first quilting stitch line is transverse to the longitudinal axis of the strands of yarn and/or bundles. In a preferred embodiment, the first quilting stitch line is orthogonal to the yarn's longitudinal axis, such as that shown in FIGS. 3B and 3C. In alternative embodiments, the yarn bundles may be stitched to only one layer in a region of the garment, with at least a portion of the other layer on the opposite side of the bundles not having stitches therethrough.

A second quilting stitch line is stitched, where the second quilting stitch line is substantially parallel with and displaced a predetermined distance from the first quilting stitch line. As will be discussed in detail in regards to FIG. 8, the predetermined distance between consecutive and parallel quilting stitch lines is based on the density of the insulating material and the required durability of the garment. The second quilting stitch line is substantially transverse to the longitudinal axis of the strands of yarn.

More quilting stitch lines are stitched and each are separated by the predetermined distance, substantially parallel with the other stitch lines, and transverse to the longitudinal axis of the strands of yarns. The number of quilting stitch lines that are required is based on the distance between the first and the second edges of the outer or inner layers and the predetermined distance between each stitch line. In some embodiments, at least one of the quilting stitch lines is separated by the first or second edge of the inner or outer surface by the predetermined distance.

In some embodiments as discussed above, prior to the stitching of the quilting stitch lines, groups of strands of yarn are laterally grouped to form a yarn bundle, such as yarn bundle 330 of FIGS. 3B and 3C. Each quilting stitch line that is stitched transversely across the bundle provides both longitudinal and lateral stabilization of the bundle. The quilting stitch lines conserve the uniform distribution of the insulating bundles throughout the lifetime of the garment constructed from the stabilized insulation. Additionally, as shown in FIGS. 2A and 2B, each strand of yarn may include fibrous tendrils and/or spirals 224 that act to provide greater lateral stabilization of the bundle and increased insulating properties, as well as to provide the garment loft and/or body.

In some embodiments, the lateral grouping of the strands into bundles occurs prior to the stitching of each quilting stitch line. The bundling may occur prior to the bundles being received by the bundle channels. In at least one embodiment, groups of strands may be braided or cabled to form an interleaving bundle, providing greater levels of lateral stabilization. In at least one embodiment, approximately 30 yarn strands are included in each bundle that is received by a bundle channel, such as bundle channel 380 of FIG. 3C. However, the actual number may vary depending on the required properties of the garment. Preferred embodiments use bundles with an insulation density between 10 and 25 strands/inch. In at least one preferred embodiment, the insulation density is 20 strands/inch. Alternatively, density insulation may be expressed in grams per square meter (GSM).

Figure 4:
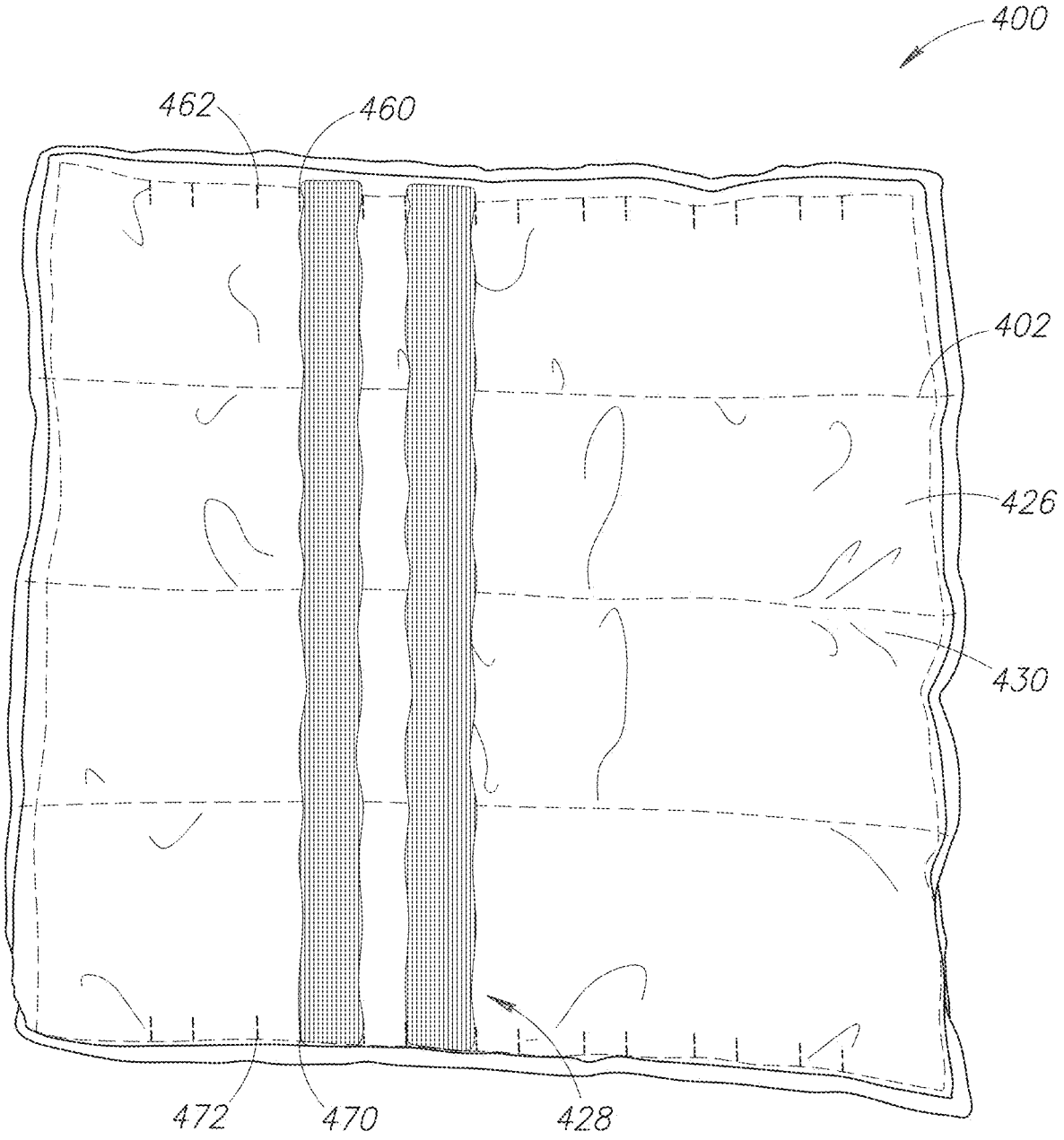
FIG. 4 illustrates another portion of an insulating garment that includes multiple transparent cutaway windows revealing embodiments of multiple insulating bundles. The bundles are stabilized with methods consistent with the various embodiments disclosed herein.

FIG. 4 illustrates another portion of an insulating garment 400 that includes two transparent cutaway windows 428 revealing embodiments of two insulating bundles, each located within a bundle channel. The bundles are shown somewhat schematically and each includes approximately 30 yarn strands. Each of the strands of yarn may include a core and numerous tendrils and/or spirals, as illustrated in FIG. 2A. Bundles 430 are stabilized with methods consistent with the various embodiments disclosed herein.

Garment portion 400 includes multiple quilting stitch lines 402, which form channels 426 separated by baffles. The outer layer of the garment is shown. Tacks, or stitches, such as 460, 462, 470, and 472 are employed to form bundle channels to enable the even distribution of the bundles. Note that the two illustrated bundles are positioned with corresponding bundle channels. The bundle channels additionally provide stabilization of the uniform distribution of the bundles prior to the stitching of quilting stitch lines 402. Note that channels 426 are substantially transverse to the bundle channels.

The lateral spacing between consecutive bundles may be varied, depending on the required properties of the garment. The lateral spacing of consecutive tacks may be varied to accommodate various lateral spacing of consecutive bundles. The bundles 430 illustrated in FIG. 4 are denser bundles than the bundles illustrated in FIG. 3B, such as bundle 330.

Figure 5:
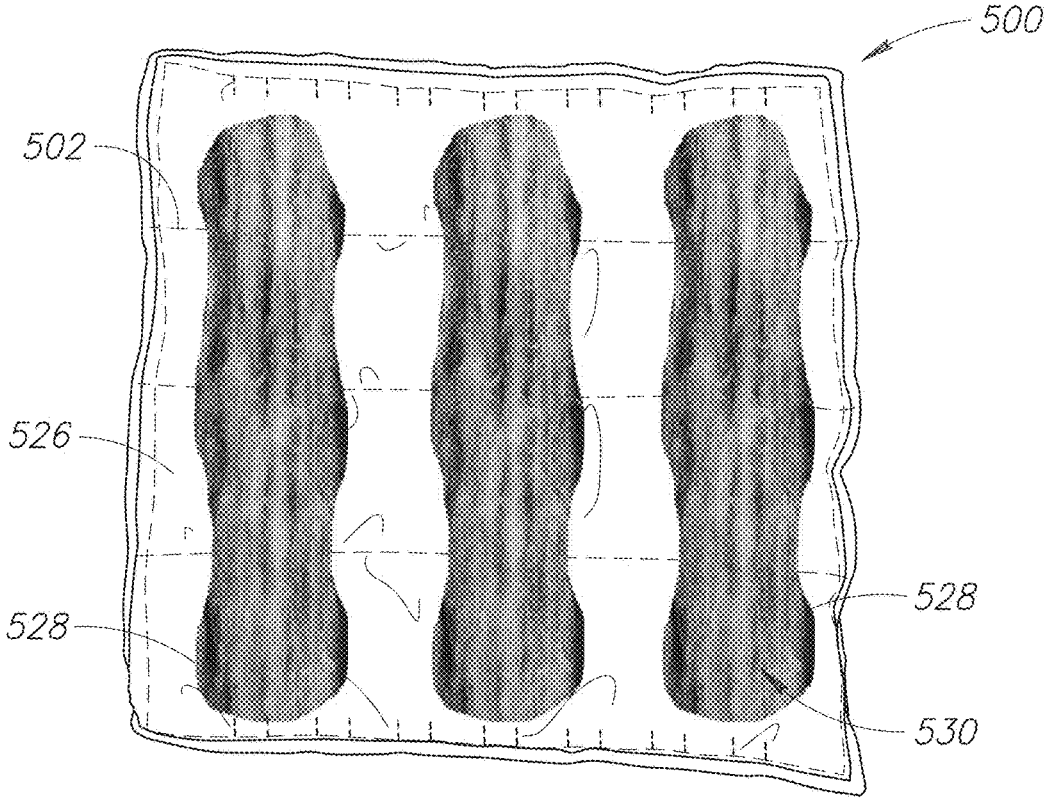
FIG. 5 illustrates still another portion of an insulating garment that includes multiple transparent cutaway windows revealing another embodiment of insulating bundles. The bundles are stabilized with methods consistent with the various embodiments disclosed herein.

FIG. 5 illustrates still another portion of an insulating garment 500 that includes multiple transparent cutaway windows 528 revealing another embodiment of insulating bundles 530. Each of the transparent cutaway windows 528 reveals several insulating bundles, such as insulating bundle 530. Insulating bundles, such as bundle 530, are stabilized with methods consistent with the various embodiments disclosed herein. Garment portion 500 includes multiple quilting stitch lines 502, which form channels 526 separated by baffles. The outer layer of the garment is shown. FIGS. 3B, 3C, 4, and 5 illustrated how the fiber density, or loft, may be varied in various embodiments. Note the tacks, such as those shown, may be employed to form bundle channels.

Figure 6:
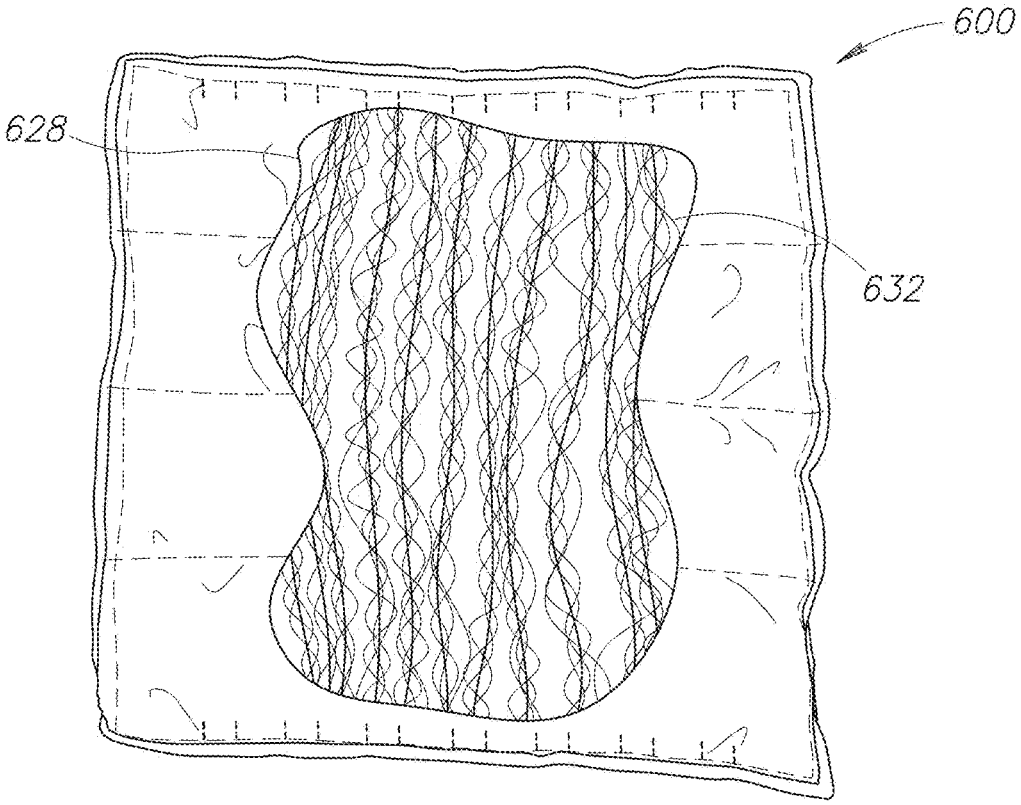
FIG. 6 illustrates yet another portion of an insulating garment that includes a transparent cutaway window revealing still another embodiment of an insulating layer that is stabilized with methods consistent with the various embodiments disclosed herein.

FIG. 6 illustrates yet another portion of an insulating garment 600 that includes a transparent cutaway window 638 revealing still another embodiment of an insulating layer 632 that is stabilized with methods consistent with the various embodiments disclosed herein. In FIG. 6, the bundles are shown somewhat schematically, but each includes multiple strands of yarn. Tacks employed to form bundle channels are also shown in FIG. 6.

Although tacks are shown in FIGS. 3B-6, because the tacks may be temporary tacks, tacks may not be present in the garments constructed from the various embodiments disclosed herein. In addition, a particular garment may be constructed from various regions of an insulating material that includes bundles stabilized with methods consistent with the various embodiments disclosed herein. Those regions of the garment may not include the tacks that were employed to distribute the bundles approximately uniformly. Accordingly, the garment may not include the tacks that are shown in FIGS. 3B-6.

Although shown only schematically, each of the strands of yarn may include a core, as well as numerous tendrils and/or spirals, such as the yarn illustrated in FIG. 2A. When the yarns are arranged in a bundle structure, these tendrils and/or spirals may at least partially fill the interstices between the cores of the yarn strands. As discussed in the context of FIG. 2B, this effect may increase the body, loft, or insulating capabilities of garments.

Figure 7:
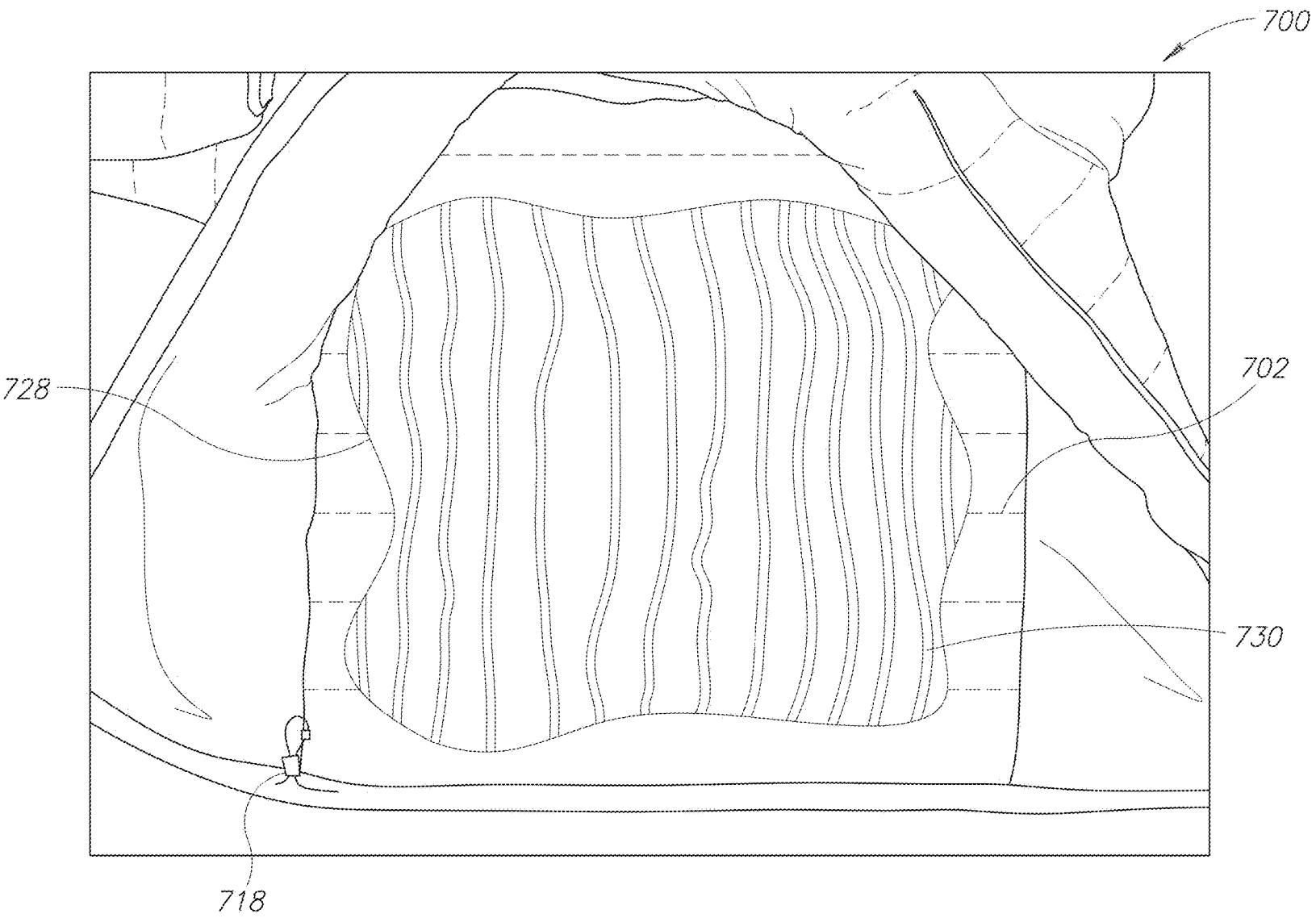
FIG. 7 illustrates a portion of a parka that includes a cutaway window revealing insulation that was stabilized with methods consistent with the various embodiments disclosed herein.

FIG. 7 illustrates a portion of a parka 700, such as parka 100 illustrated in FIG. 1A, that includes a cutaway window 728 revealing insulation stabilized with methods consistent with the various embodiments disclosed herein. Transparent window 728 is located on the inner surface of the inner layer of parka 700. Accordingly, transparent window 728 would be adjacent to the wearer's back if parka 700 was worn.

Parka 700 includes multiple quilting stitch lines 702. The quilting stitch lines 702 provide lateral and longitudinal stabilization for the plurality of insulating bundle structures 730. As with various figures herein, the bundles illustrated in FIG. 7, such as bundle 730, are shown schematically. The bundles may include multiple strands of spun yarn. The spun yarn may include a core and numerous tendrils and/or spirals. In some embodiments, parka 700 includes cinching means 718.

FIG. 8 is a graph that illustrates preferred insulation densities as a function of quilting stitch line spacing. Generally, the greater the distance between quilting stitch line spacing (quilt spacing), the greater the effective loft of the garment. However, the wash durability of the garment decreases with increasing quilt spacing.

Additionally, increased densities of the insulation material increase the durability of the garment and require less frequent quilting to achieve disabilities similar to those of lower density insulation bundles. For preferred embodiments, the graph in FIG. 8 shows recommended quilt spacing for different densities of insulation to retain acceptable wash durability enhancing the loft of the garment.

As noted above, in one preferred embodiment, bundle channels widths of approximately 1.5 inches are employed to uniformly distribute and at least temporarily stabilize the bundles, prior to stitching the quilting stitch lines. The bundles may include approximately 30 yarn strands. In such embodiments, the resulting density of insulation is approximately 20-yarn strands/inch (or ~87 GSM). Accordingly, the preferred spacing between the transverse quilting stitch lines is approximately 3 inches. Although, the graph illustrated in FIG. 8 demonstrates that other preferred embodiments may employ alternative insulating densities, spacing of quilting stitching lines, and/or various bundle channel widths.

Figure 9A:
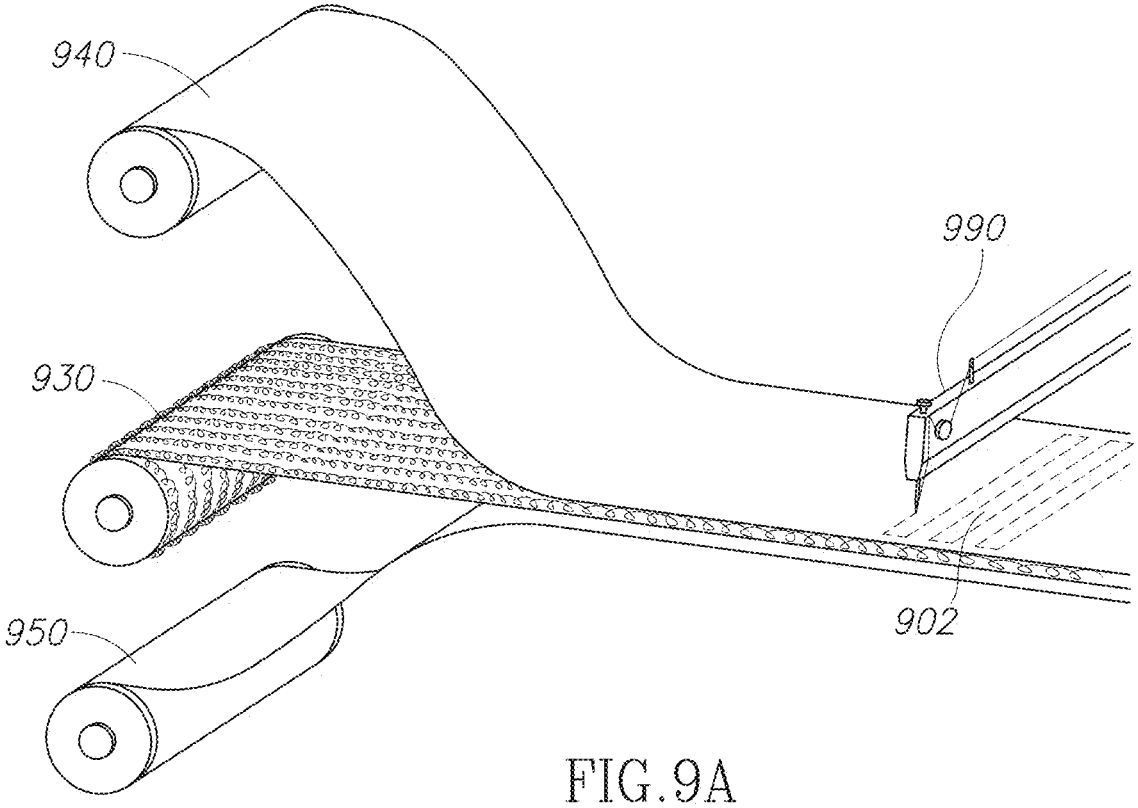
FIG. 9A illustrates an alternative method of stabilizing a plurality of insulating fibers. The method being consistent with the various embodiments disclosed herein.

FIG. 9A illustrates an alternative method of stabilizing a plurality of insulating fibers. The method being consistent with the various embodiments disclosed herein. The method may be employed in the construction of an insulating garment.

The method illustrated in FIG. 9A employs a beam of a first material 940 and a beam of a second material 950. The first material may be inner fabric material such as lining material. The second material may be an outer material, such as a shell material. The method additionally employs a beam of spun yarn 930. The beam of spun yarn 930 may be arranged into bundle structures. The beams are rolled to create a layer of the insulating spun yarn sandwiched between the first and second materials.

Quilting stitch lines, such as quilting stitch lines 902 may be stitched to stabilize the bundles of the spun yarn material. Quilting stitch lines 902 may be substantially transverse to the bundle structures of the spun yarn. Automated quilting head 990 may be employed to stitch the quilting stitch lines 902. After the sandwiched material is formed and the bundles are stabilized, the material may be cut and assembled into various insulating garments.

Figure 9B:
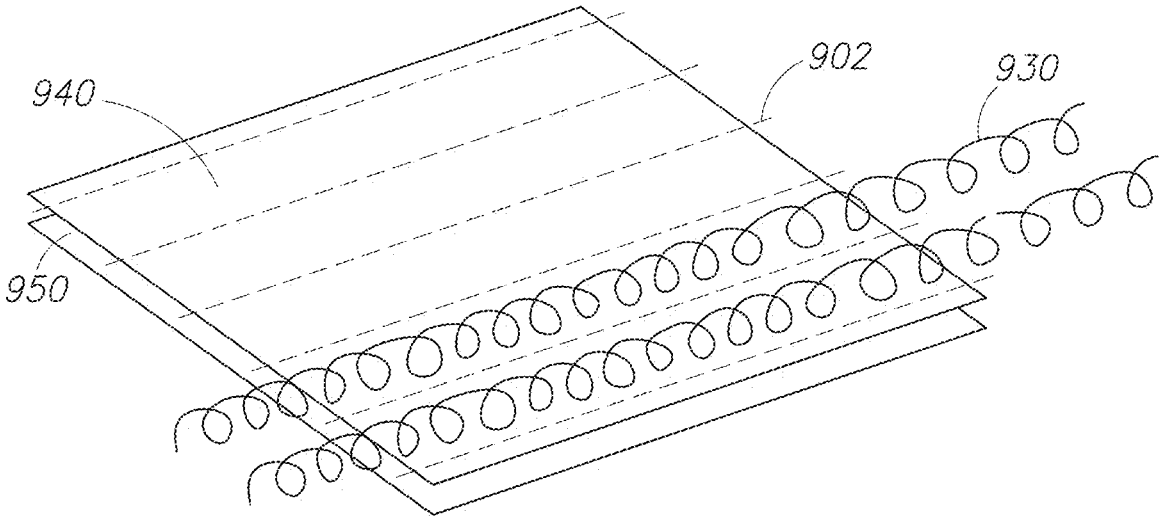
FIG. 9B illustrates another alternative method of stabilizing a plurality of insulating fibers.

FIG. 9B illustrates another alternative method of construction of an insulating garment, including the portion of insulating garment. In the method illustrated in FIG. 9B, bundle channels are pre-sown into a first material layer 940 and a second material layer 950. The bundle channels are formed by stitching quilting stitch lines 902 into the first material layer 940 and the second material layer 950. The bundles are aligned in the bundle channels and the quilting stitch lines are substantially parallel with the bundles.

Figure 10A:
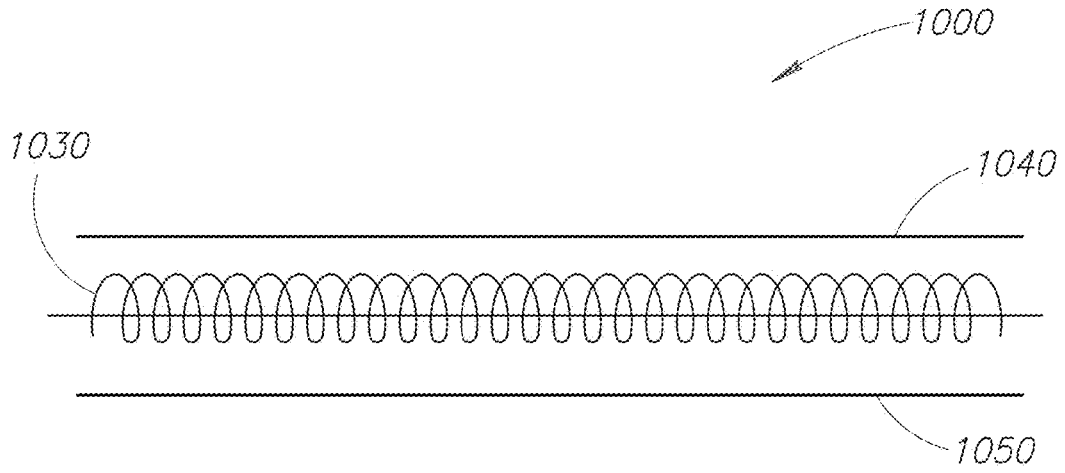
FIG. 10A illustrates a semi-schematic side view of an embodiment of a bundle received by a bundle channel.

FIG. 10A illustrates a semi-schematic side view of an embodiment 1000 of a bundle 1030 received by a bundle channel, such as bundle channel 380 of FIG. 3C. The bundle channel is formed by inner fabric layer 1040, outer fabric layer 1050, and a plurality of tacks (not shown), such as tacks 360, 362, 370, and 372 of FIG. 3C.

The longitudinal axis of bundle 1030, shown by the horizontal line running through bundle 1030, is parallel with the axis of the bundle channel. In a finished garment, bundle stabilizing stitch lines (not shown), such as stitch lines 302 of FIGS. 3B and 3C, would be perpendicular to the page. The stitch lines would be substantially perpendicular to both the longitudinal axis of bundle 1030 and the axis of the bundle channel. In embodiment 1000, bundle 1030 lies substantially "flat" within the bundle channel. The total longitudinal length of bundle 1030 that is within the bundle channel is substantially equal to the longitudinal length of the bundle channel.

Figure 10B:
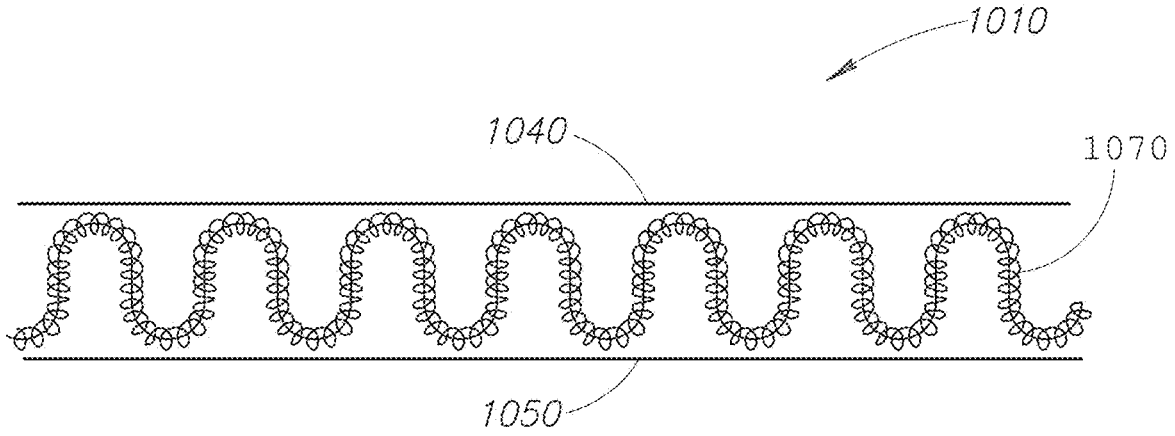
FIG. 10B illustrates a semi-schematic side view of an alternative embodiment of a bundle received by a bundle channel.

FIG. 10B illustrates a semi-schematic side view of an alternative embodiment 1010 of a bundle 1070 received by a bundle channel. Similar to embodiment 1000 of FIG. 10A, the bundle channel of embodiment 1010 is formed by inner fabric layer 1040, outer fabric layer 1050, and a plurality of tacks (not shown).

Bundle 1070 of embodiment 1010 has been "bunched" into the bundle channel and does not lie flat, such as in embodiment 1000. Rather, bundle 1070 of FIG. 10B has been pushed, or fed, into the bundle channel to form a bunching effect. Note that, when "bunched", the longitudinal axis of bundle 1070 is somewhat serpentine and is not parallel with the axis of the bundle channel.

This bunching allows for a greater length of bundle 1070 to be received by the bundle channel, which increases the insulating value of a garment constructed from such an embodiment. In some embodiments, the bunching is accomplished by hand-feeding bundle 1070 into the bundle channel. In other embodiments, feeding the bundles into the corresponding bundle channels is automated. The bunching can be accomplished prior to, or during, the stitching of the stabilizing quilting stitch lines. Bunching bundle 1070 results in an increase of dead air within each bundle channel and thus a further increase in the insulating capabilities of the finished garment. Bunching the bundles also increases the "fluffiness" of the garments.

As shown in FIG. 10B, the bunching of bundle 1070 is substantially within the plane defined by the side view, such that the longitudinal axis of bundle 1070 remains in the plane of the page. In some embodiments, at least a portion of the bunching is perpendicular to this plane, such that some portions of the longitudinal axis of the bundle 1070 is perpendicular to the plane defined by the side view.

All of the embodiments and methods disclosed and claimed herein can be made and executed without undue experimentation in light of the present disclosure. While the garments and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope, and concept of the invention as defined by the appended claims.

The embodiments of the invention in which an exclusive property or privilege is claimed are defined as follows:

1. An insulating garment, the garment including:
an inner layer;
an outer layer;
a first coupling line;
a second coupling line; and
an insulating layer disposed intermediate the inner layer and the outer layer, the insulating layer consisting:
a first bundle structure;
a second bundle structure; and
a plurality of other bundle structures,
wherein each of the first and the second bundle structures comprises a plurality of yarn strands, each yarn strand includes a core yarn and a plurality of at least one of tendrils and spirals around the core yarn,
wherein the first bundle structure is disposed laterally adjacent the second bundle structure, the first and second bundle structures not being completely isolated one from the other such that the at least one of the tendrils and the spirals of both of the first and second the bundle structures at least partially fill the space between the plurality of yarn strands of the first and second bundle structures and provide loft and insulation,
wherein the first bundle structure, the second bundle structure, and the plurality of other bundle structures are disposed intermediate the inner layer and the outer layer,
wherein each of the plurality of other bundle structures has a plurality of yarn strands, each yarn strand of the other bundle structures including a core yarn having plurality of at least one of tendrils and spirals around the core yarn of each of the plurality of other bundle structures, and each of the first bundle structure, the second bundle structure, and the plurality of other bundle structures has a respective longitudinal axis,
wherein the respective longitudinal axis of each of the first bundle structure, the second bundle structure, and the plurality of other bundle structures is spatially discontiguous in at least two dimensions relative to each respective longitudinal axis of each other one of the first bundle structure, the second bundle structure, and the plurality of other bundle structures,
wherein the first and the second coupling lines are each transverse to each respective longitudinal axis of each of the first bundle structure, the second bundle structure, and the plurality of other bundle structures, each of the first and second coupling lines securing the first and second bundle structures, wherein the first and the second coupling lines are separated by a predetermined distance with each of the first bundle structure, the second bundle structure, and the plurality of other bundle structures held side by side by the coupling lines,
wherein no coupling secures the inner layer to the outer layer between the first and second coupling lines such that there is no isolation between the first bundle structure and the second bundle structure between the first and second coupling lines, and
wherein a bundle channel is formed by a plurality of bundle channel stitch lines that are substantially parallel to a bundle channel longitudinal axis and couple the inner layer and the outer layer.

2. The garment of claim 1, wherein the first bundle structure is received by a first bundle channel, such that the longitudinal axis of the first bundle structure is substantially parallel with a first bundle channel longitudinal axis.

3. The garment of claim 1, wherein the predetermined distance is between 2 and 4 inches.

4. The garment of claim 1, wherein a plurality of bundle channels is configured and arranged to at least partially stabilize a distribution of a plurality of bundle structures, which include the first and the second bundle structures, received by the plurality of bundle channels prior to securing the first and the second coupling lines.

5. The garment of claim 1, wherein the first and second coupling lines are quilting stitch lines.

6. The garment of claim 1, wherein the inner layer and outer layer each have a top edge, bottom edge, left edge, and right edge;
a plurality of coupling lines secure the inner layer and outer layer to one another and extend between the left edge and the right edge, each coupling line of the plurality of coupling lines extending across each core yarn of the plurality of yarn strands of the first and second bundle structures; and
wherein no coupling secures the inner layer to the outer layer between adjacent coupling lines of the plurality of coupling lines such that there is no isolation between the first bundle structure and the second bundle structure between any of the coupling lines of the plurality of coupling lines.

7. The garment of claim 1, wherein the at least one of the tendrils and the spirals have a length that is greater than a separation between the first bundle structure and the second bundle structure.

8. The garment of claim 1, wherein the at least one of the tendrils and the spirals extend completely across a separation between the first bundle structure and the second bundle structure.

9. The garment of claim 1, wherein the first and the second coupling lines are disposed at approximately 90° to each respective longitudinal axis of each of the first bundle structure, the second bundle structure, and the plurality of other bundle structures.

10. The garment of claim 1, wherein the first and the second coupling lines are orthogonal to each respective longitudinal axis of each of the first bundle structure, the second bundle structure, and the plurality of other bundle structures.

11. An insulating garment, the garment including:
an inner layer;
an outer layer;
a first coupling line;
a second coupling line;
an insulating layer disposed intermediate the inner layer and the outer layer, the insulating layer consisting:
a first bundle structure;
a second bundle structure; and
a plurality of other bundle structures; and
a plurality of bundle channels defined by a first plurality of tacks disposed adjacent to a first edge of at least one of the inner layer or the outer layer and a corresponding second plurality of tacks disposed adjacent to a second edge of the at least one of the inner layer or the outer layer, wherein consecutive tacks in the first plurality of tacks are separated by another predetermined distance and each of the second plurality of tacks are aligned with a corresponding tack in the first plurality of tacks,
wherein each of the first and the second bundle structures comprises a plurality of yarn strands, each yarn strand includes a core yarn and a plurality of at least one of tendrils and spirals around the core yarn, wherein the first bundle structure is disposed laterally adjacent the second bundle structure, the first and second bundle structures not being completely isolated one from the other such that the at least one of the tendrils and the spirals of both of the first and second the bundle structures at least partially fill the space between the plurality of yarn strands of the first and second bundle structures and provide loft and insulation, wherein the first bundle structure, the second bundle structure, and the plurality of other bundle structures are disposed intermediate the inner layer and the outer layer, wherein each of the plurality of other bundle structures has a plurality of yarn strands, each yarn strand of the other bundle structures including a core yarn having a plurality of at least one of tendrils and spirals around the core yarn of each of the plurality of other bundle structures, and each of the first bundle structure, the second bundle structure, and the plurality of other bundle structures has a respective longitudinal axis, wherein the respective longitudinal axis of each of the first bundle structure, the second bundle structure, and the plurality of other bundle structures is spatially discontiguous in at least two dimensions relative to each respective longitudinal axis of each other one of the first bundle structure, the second bundle structure, and the plurality of other bundle structures, wherein the first and the second coupling lines are each transverse to each respective longitudinal axis of each of the first bundle structure, the second bundle structure, and the plurality of other bundle structures, each of the first and second coupling lines securing the first and second bundle structures, wherein the first and the second coupling lines are separated by a predetermined distance with each of the first bundle structure, the second bundle structure, and the plurality of other bundle structures held side by side by the coupling lines, wherein the first plurality of tacks and second plurality of tacks each comprise lines of stitching that are transverse to the first and second coupling lines, wherein the first plurality of tacks extend from the first edge only partially across the inner layer and outer layer and do not intersect the first and second coupling lines and do not intersect any other coupling line extending transverse to each of the first and the second bundle structures' longitudinal axis, wherein the second plurality of tacks extend from the second edge only partially across the inner layer and outer layer and do not intersect the first and second coupling lines and do not intersect any other coupling line extending transverse to each of the first and the second bundle structures' longitudinal axis.

12. The garment of claim 11, wherein the first bundle structure is received by a first bundle channel in the plurality of bundle channels, such that the longitudinal axis of the first bundle structure is substantially parallel with a first bundle channel longitudinal axis defined by the first bundle channel.

13. The garment of claim 11, wherein the first plurality of tacks couple the inner layer and the outer layer to each other.

14. The garment of claim 11, wherein the plurality of bundle channels is configured and arranged to receive the first bundle structure, the second bundle structure, and the plurality of other bundle structures prior to securing the first and second coupling lines and to at least partially stabilize a distribution of the first bundle structure, the second bundle structure, and the plurality of other bundle structures.

15. The garment of claim 11, wherein no coupling secures the inner layer to the outer layer between the first and second coupling lines such that there is no isolation between the first bundle structure and the second bundle structure between the first and second coupling lines.

16. The garment of claim 11, wherein the inner layer and outer layer each have a top edge, bottom edge, left edge, and right edge, wherein a plurality of coupling lines secure the inner layer and outer layer to one another and extend between the left edge and the right edge, each coupling line of the plurality of coupling lines extending across each core yarn of the plurality of yarn strands of the first and second bundle structures, wherein no coupling secures the inner layer to the outer layer between adjacent coupling lines of the plurality of coupling lines such that there is no isolation between the first bundle structure and the second bundle structure between any of the coupling lines of the plurality of coupling lines.

17. The garment of claim 11, wherein the first and second coupling lines are quilting stitch lines.

18. The garment of claim 11, wherein the at least one of the tendrils and the spirals have a length that is greater than a separation between the first bundle structure and the second bundle structure.

19. The garment of claim 11, wherein the at least one of the tendrils and the spirals extend completely across a separation between the first bundle structure and the second bundle structure.

* * * * *